US006701943B1

(12) United States Patent
Martolock et al.

(10) Patent No.: US 6,701,943 B1
(45) Date of Patent: Mar. 9, 2004

(54) SYSTEM FOR CLEANING PERFORATED PANELS

(75) Inventors: Randall B. Martolock, Tecumseh, MI (US); Alan L. Schafer, Onstead, MI (US)

(73) Assignee: Midwest Waterblasting Corporation, Clinton, MI (US)

( * ) Notice: Subject to any disclaimer, the term of this patent is extended or adjusted under 35 U.S.C. 154(b) by 0 days.

(21) Appl. No.: 09/801,087

(22) Filed: Mar. 7, 2001

Related U.S. Application Data

(60) Provisional application No. 60/187,789, filed on Mar. 8, 2000.

(51) Int. Cl.[7] ..... B08B 3/02

(52) U.S. Cl. ..... 134/78; 134/82; 134/199; 134/181

(58) Field of Search ..... 134/61, 64 R, 134/78, 82, 122 R, 199, 181; 198/717, 718, 719, 720, 721, 722, 723, 724, 725, 726, 727, 728, 729, 730, 731, 732, 733, 734, 735.1, 749

(56) References Cited

U.S. PATENT DOCUMENTS 1,703,466 A * 2/1929 Wright
1,720,622 A * 7/1929 Breton
2,651,065 A * 9/1953 O'Connor
2,671,241 A * 3/1954 Starner
2,936,770 A * 5/1960 Emanuel
2,971,634 A * 2/1961 Wilde et al.
3,098,250 A * 7/1963 Creech
3,405,720 A * 10/1968 Carlson
3,460,547 A * 8/1969 Gribas et al.
3,501,385 A * 3/1970 Jasberg
3,513,974 A * 5/1970 Markwick
3,610,391 A * 10/1971 Beck
3,634,122 A * 1/1972 Grefe et al.
3,760,824 A * 9/1973 Edwards et al.
3,827,262 A * 8/1974 Manuel
4,067,293 A * 1/1978 Probst
4,281,675 A * 8/1981 Pure
4,338,958 A * 7/1982 Fujita
4,427,019 A * 1/1984 Eidschun
4,506,687 A * 3/1985 Rosch, III
4,566,951 A * 1/1986 Norberg et al.
4,651,925 A * 3/1987 Harris
4,732,173 A * 3/1988 Czaja et al.
4,971,083 A * 11/1990 Stach et al.
5,581,836 A * 12/1996 Kelber
5,769,956 A * 6/1998 Cord et al.
5,862,820 A * 1/1999 Kageyama et al.

FOREIGN PATENT DOCUMENTS

FR 2669906 * 6/1992

* cited by examiner

*Primary Examiner*—Frankie L. Stinson
(74) *Attorney, Agent, or Firm*—Raphael A. Monsanto; Benita J. Rohm

(57) ABSTRACT

A system for cleaning grates includes a first power wash portion for applying a pressurized wash fluid to a first side of a grate, and a second power wash portion for applying a further pressurized wash fluid to a second side of the grate. A receiving portion, which is detachable from the first power wash portion, receives the grate, and a transport arrangement transports the grate along a grate path through the first and second power wash portions. A grate delivery portion, which is detachable from the second power wash portion to enhance portability and facilitate maneuverability, delivers the grate after it has been transported through the second power wash portion. A grate drive arrangement engages mechanically with the grate and urges same along the grate path from the receiving portion to the first power wash portion. A method aspect of the invention includes the steps of transporting the grates along a grate path the begins with a receiving portion and a delivery portion; first subjecting a first side of each grate to a stream of pressurized cleaning fluid; and second subjecting a second side of each grate to a further stream of pressurized cleaning fluid.

23 Claims, 4 Drawing Sheets

SYSTEM FOR CLEANING PERFORATED PANELS

CROSS-REFERENCE TO RELATED APPLICATIONS

This application is a continuation, and claims the benefit, of provisional patent application No. 60/187,789 filed Mar. 8, 2000 to the same applicants as herein.

BACKGROUND OF THE INVENTION

1. Field of the Invention

This invention relates generally to the cleaning of perforated panels, such as the floor grates of a painting booth, using pressurized fluid, and more particularly, to a to a system that cleans both sides of a perforated panel in one pass through a multistage cleaning apparatus.

2. Description of the Related Art

Perforated panels, and particularly the floor grates of a painting booth, particularly of the type used in the automotive industry, present difficult cleaning challenges. In the case of a painting booth floor grate, a significant amount of airborne paint is accumulated and permitted to dry thereon. Ordinarily, cleaning of such grates requires that they be removed to a cleaning work site where they are subjected to the cleaning action of applied pressurized water.

The grates are placed for cleaning in a horizontal orientation at the cleaning work site where a pressurized water dispensing arrangement is applied to the upper surface of each grate. Each grate is then turned over, and the process is repeated on the second side. Once the grates are cleaned on both sides, they are transported back to the paint booth site, where they are reinstalled. In addition to the obvious disadvantages of requiring round trip transportation and the time consuming effort of the known one-side-at-a-time cleaning, the known system of cleaning grates is plagued with the additional disadvantages of requiring a replacement set of grates to be installed in the paint booth while the original set of grates is being cleaned, and certification under environmental laws of the cleaning work site for disposal of the dried paint removed from the grates.

It is, therefore, an object of this invention to provide a grate cleaning system that rapidly will clean both sides of the grate.

It is another object of this invention to provide a grate cleaning system that does not require removal of the grates to a remote cleaning work site.

It is also an object of this invention to provide a grate cleaning system that avoids the need to certify a remote work site under the environmental laws.

It is a further object of this invention to provide a grate cleaning system that easily can be transported to the site of a painting booth.

It is additionally an object of this invention to provide a grate cleaning system that easily can be loaded and/or unloaded from a light duty vehicle by a minimum number of work personnel.

It is yet a further object of this invention to provide a grate cleaning system that easily can be maneuvered in confined quarters.

SUMMARY OF THE INVENTION

The foregoing and other objects are achieved by this invention which provides a system for cleaning grates or other perforated panels. In accordance with a first apparatus aspect of the invention, the system includes a first power wash portion for applying a pressurized wash fluid to a first side of a first grate. Additionally, a second power wash portion applies a further pressurized wash fluid to a second side of the first grate. Passage of the first grate in the vicinity of the first and second power wash portions is achieved by a transport arrangement that transports the first grate along a grate path through the first and second power wash portions.

In an advantageous embodiment of the invention, the pressurized wash fluid and the further pressurized wash fluid are obtained from a common source. However, in a preferred embodiment, the pressurized wash fluid and the further pressurized wash fluid are both pressurized wash water obtained from a common water source.

In another embodiment of the invention, there is further provided a grate delivery portion for receiving the first grate after it has been transported through the second power wash portion. A highly advantageous feature of the invention is that the grate delivery portion is arranged to be detachable from the second power wash portion. This enhances portability of the system, as well as facilitate its maneuverability at the work site.

The system of the invention additionally is provided, in a further embodiment thereof, with a receiving portion for receiving the first grate. In a manner similar to the detachability of the grate delivery portion from the second power wash portion, the receiving portion of the transport arrangement is arranged to be detachable from the first power wash portion. There is additionally provided a grate drive arrangement for engaging with the first grate and urging same along a first portion of the grate path from the receiving portion to the first power wash portion. The transport arrangement is arranged to be detachable from the first power wash portion.

The drive arrangement is provided with a rotatory driver element for producing a rotatory displacement, and a flexible driven element coupled to the rotatory driver and adapted to engage with the first grate. In this manner, the first grate is urged along the grate path from the receiving area to the first power wash portion in response to the rotatory displacement of the rotatory driver element. A second grate is received at the receiving area sequentially behind the first grate, the second grate also being urged along the grate path from the receiving area to the first power wash portion in response to the rotatory displacement of the rotatory driver element. In this embodiment, the second grate urges the first grate along a second portion of the grate path from the first wash portion to the second wash portion.

In one embodiment of this first apparatus aspect of the invention, the first power wash portion include a first pressurized fluid source for delivering a stream of pressurized fluid to the first side of the first grate. A first cover is detachably arranged on the other side of the grate path from the first displaceable pressurized fluid source for forming a power wash chamber in the first power wash portion. A second power wash portion is formed of a second pressurized fluid source for delivering a stream of pressurized fluid to the second side of the first grate. In similar manner to the first power wash portion, a second cover is detachably arranged on the other side of the grate path from the second displaceable pressurized fluid source for forming a second power wash chamber that is located in the second power wash portion. Of course, the second power wash chamber being arranged sequential to the first power wash chamber along the grate path.

In a further embodiment of this first apparatus aspect of the invention, the first pressurized fluid source includes a first displaceable nozzle for providing the stream of pressurized fluid directed toward the first side of the first grate. The stream of pressurized fluid is displaceable with respect to the first grate. Preferably, the first displaceable nozzle is rotationally displaceable. Such rotational displacement is responsive to a first nozzle drive that is arrangement that is arranged to drive the first displaceable nozzle and the stream of pressurized fluid along a predetermined path with respect to the first side of the first grate. The first nozzle drive arrangement drives the first displaceable nozzle along a substantially arcuate path that is substantially parallel to the first side of the first grate.

In accordance with a second apparatus aspect of the invention, there is provided a system for washing grates of the type used in the ventilation of painting booths. The system is provided with a first power wash portion for applying a moving stream of pressurized wash water to a first side of each grate. Additionally, a first power wash drive arrangement urges the stream of pressurized wash water along a first predetermined stream path, while a second power wash portion for applies a further moving stream of pressurized wash water to a second side of each grate. A second power wash drive arrangement urges the further stream of pressurized wash water along a second predetermined stream path, and a grate transport arrangement urges the grates in sequence along a grate path through the first and second power wash portions.

In one embodiment of this second apparatus aspect of the invention, the grate transport arrangement includes a grate receiving portion for receiving each grate and defining a first portion of the grate path. A cleaning portion of the grate path conducts each grate through the first and second power wash portions. Additionally, there is provide a grate delivery portion for depositing each grate after same has been cleaned. Preferably, the grate transport arrangement is arranged to transport the grates in a vertical orientation along the grate path, and there is further provided a guide arrangement for maintaining the vertical orientation throughout the grate path.

In a highly advantageous embodiment, the grate receiving portion is detachable from the cleaning portion of the grate path. Additionally, in order to maximize compactness during transport and maneuverability on the work site, the grate delivery portion is detachable from the cleaning portion of the grate path.

A grate drive arrangement for imparts a translation force to each grate in the direction of the grate path. Each subsequent grate imparts the translation force to a sequentially prior grate in the grate path.

As previously described, first and second detachable covers form respective first and second power wash chambers that include respective ones of the first and second power wash drive arrangement. The first and second power wash chambers are sequentially arranged along the grate path. A support wheel for supports the first and second power wash chambers and facilitates mobility thereof.

In accordance with a method aspect of the invention, there is provided a method of cleaning grates of the type used in the ventilation of painting booths. The method includes the steps of:

transporting the grates along a grate path the begins with a receiving portion and a delivery portion;

first subjecting a first side of each grate to a stream of pressurized cleaning fluid; and second subjecting a second side of each grate to a further stream of pressurized cleaning fluid.

In one embodiment of this method aspect, prior to performing the step of transporting there is provided the further step of installing the receiving portion onto a power wash station where the step of first subjecting is performed. In a further embodiment, prior to performing the step of transporting there is provided the further step of installing the delivery portion onto a power wash station where the step of second subjecting is performed.

In a still further embodiment of the invention, prior to performing the step of transporting there is provided the further step of installing a cover portion onto a power wash station where the step of first subjecting is performed, to form a first power wash chamber that encloses an associated portion of the grate path. A stream of pressurized cleaning fluid is moved within the first power wash chamber. Similarly, prior to performing the step of transporting there is provided the further step of installing a cover portion onto a power wash station where the step of second subjecting is performed, to form a second power wash chamber that encloses an associated portion of the grate path. The stream of pressurized cleaning fluid is moved within the second power wash chamber.

BRIEF DESCRIPTION OF THE DRAWINGS

Comprehension of the invention is facilitated by reading the following detailed description, in conjunction with the annexed drawing, in which.

DETAILED DESCRIPTION

Figure 1:
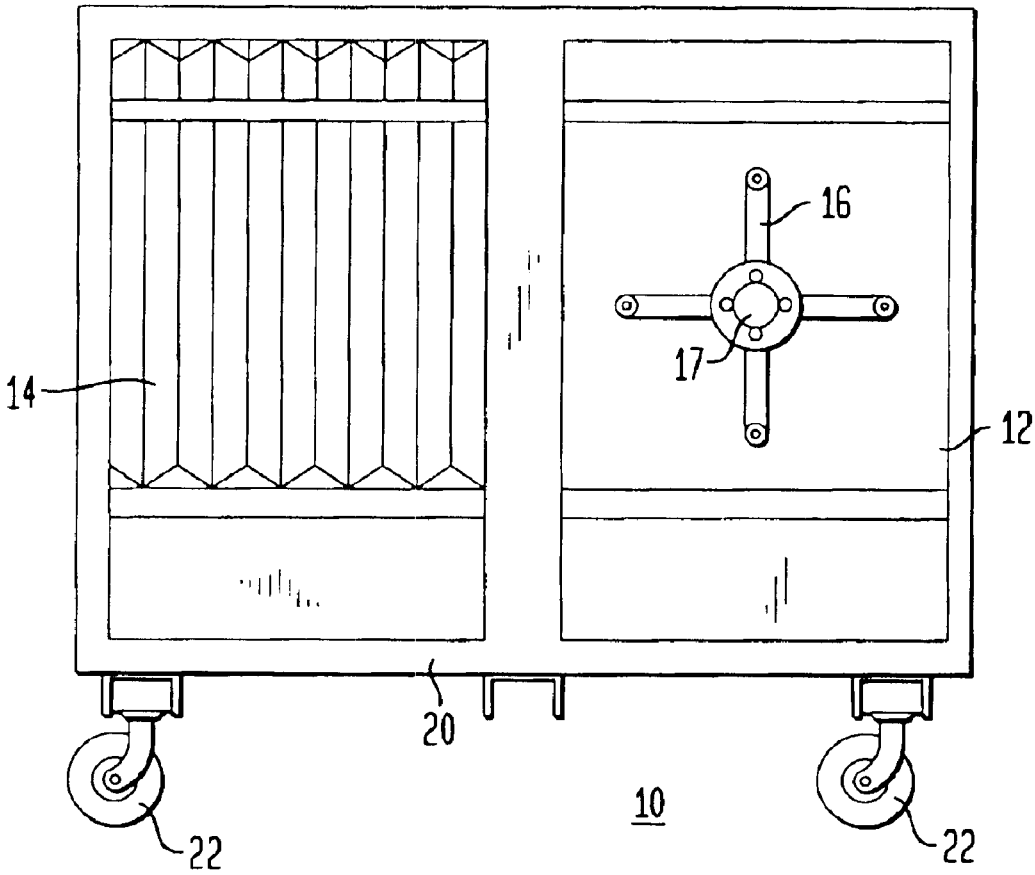
FIG. 1 is a simplified schematic plan representation of a dual compartment washer unit constructed in accordance with the principles of the invention.

FIG. 1 is a simplified schematic plan representation of a dual compartment washer unit 10 constructed in accordance with the principles of the invention. As shown, dual compartment washer unit 10 has a first washer compartment 12 and a second washer compartment 14. The first and second washer compartments are shown to be coupled to one another in a sequential arrangement, as will be discussed in greater detail hereinbelow. In addition, first washer compartment 12 is provided with a first multi-nozzle pressurized fluid dispenser 16 which is arranged to be rotatable about its center 17. There is additionally provided a second multi-nozzle pressurized fluid dispenser (not shown in this figure) disposed in second washer compartment 14. The second multi-nozzle pressurized fluid dispenser is oriented in opposition to first multi-nozzle pressurized fluid dispenser 16. That is, first multi-nozzle pressurized fluid dispenser 16 is oriented to dispense the pressurized fluid (not shown) out of the plane of the figure (i.e., toward the viewer), while the second multi-nozzle pressurized fluid dispenser is oriented to dispense the pressurized fluid (not shown) into the plane of the figure (i.e., away from the viewer).

Dual compartment washer unit 10 is shown to have, in this specific illustrative embodiment of the invention, a unitary housing 20 that is supported by four casters 22. The casters are of the steerable type and facilitate the maneuvering of dual compartment washer unit 10 in fairly tight quarters (not shown).

Figure 2:
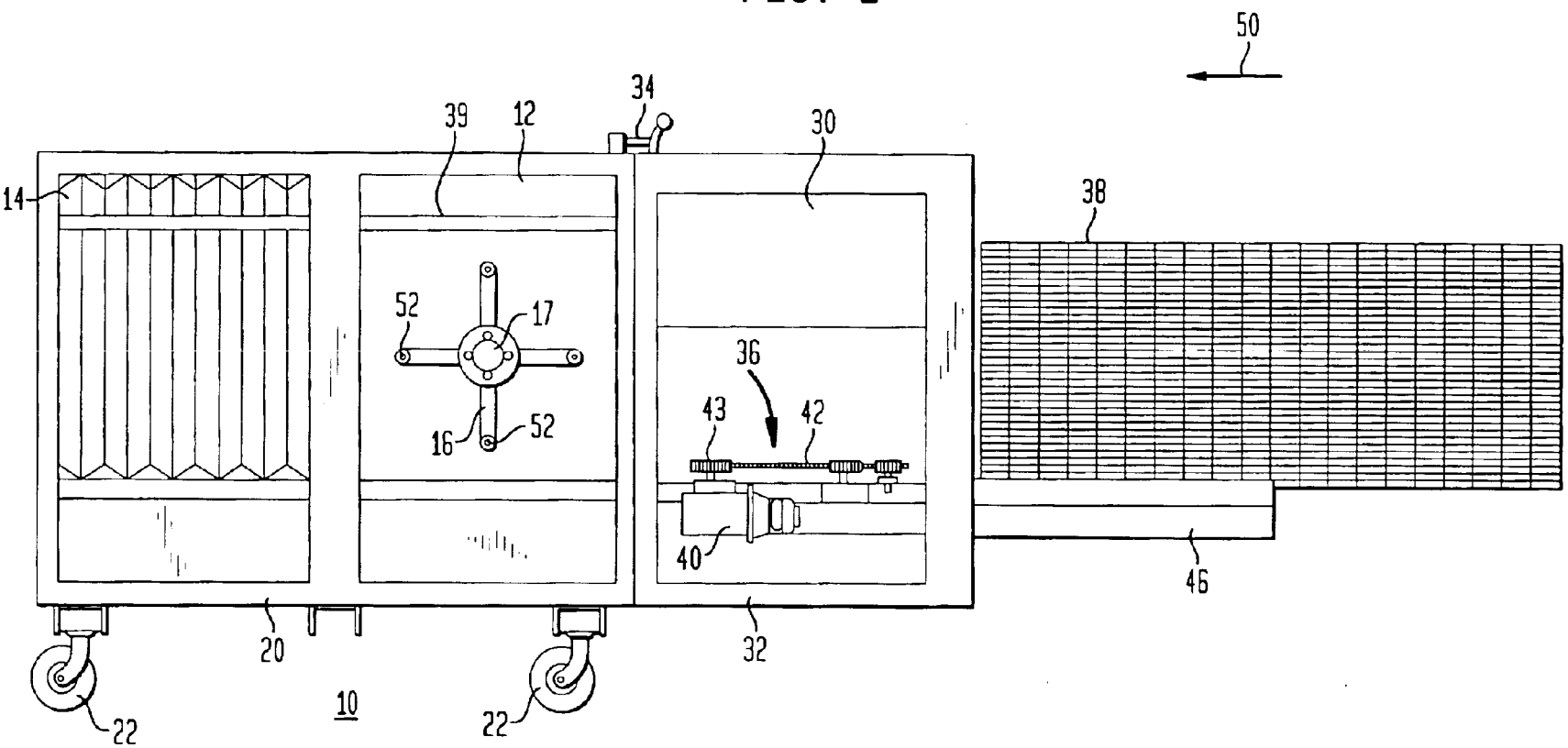
FIG. 2 is a simplified schematic plan representation of the dual compartment washer unit of FIG. 1 shown in combination with a grate receiving portion and a drive arrangement for moving the grate through the dual compartment washer unit.

FIG. 2 is a simplified schematic plan representation of dual compartment washer unit 10 shown in combination with a grate receiving portion 30. Grate receiving portion 30 has its own associated housing 32 that is detachably coupled in this figure to dual compartment washer unit 10. Any known suitable latching arrangement, such as schematically illustrated latch 34 can be employed to effect the coupling between housings 20 and 32.

Grate receiving portion 30 is additionally provided with a drive arrangement 36 that applies a linear force for effecting translation of a first grate 38 through the dual compartment washer unit. In this specific illustrative embodiment of the invention, drive arrangement 36 employs a motor 40 that is coupled to a drive chain 42 via a sprocket 43.

In operation, first grate 38 is installed by a human operator (not shown) on a receiving dock 46 that supports at least a portion of the grate and defines a first portion of a path of translation of the grate as it is urged through grate receiving portion 30 and subsequently through dual compartment washer unit 10. The human operator, in this specific illustrative embodiment of the invention, after mounting the grate onto the receiving ramp, will push the grate therealong until it communicates with drive arrangement 36. At least one protuberance (not shown) extends outward of drive chain 42 so as to engage with the grate and drive same along the path of translation (not specifically designated) in the direction of arrow 50. When the grate is at least partially disposed within first washer compartment 12, pressurized fluid, which may be water, is issued, in this embodiment, from four nozzles 52, which as previously stated, are rotated about center 17. The pressurize fluid effects cleaning of first grate 38 on the distal side thereof from the point of view of the figure. There is provided in this embodiment of the invention an upper grate guide 39 that serve to maintain the grates in vertical orientation as they are passed through the first and second washer compartments.

First grate 38 continues to travel in the direction of arrow 50 and ultimately reaches second washer compartment 14. At this point, the washing process is repeated with the second multi-nozzle pressurized fluid dispenser, which as previously indicated, is oriented in opposition to first multi-nozzle pressurized fluid dispenser 16. The second multi-nozzle pressurized fluid dispenser effects cleaning of the viewable side of the first grate.

In this specific illustrative embodiment of the invention, drive arrangement 36 will not drive the first grate all of the way through second washer compartment 12. The first grate, therefore, can be pule through by the human operator, or by a second grate (not shown) that is installed by the human operator on receiving dock 46. With both, the first and second grates installed on dual compartment washer unit 10, the second grate will push the first grate through the second washer compartment.

Figure 3:
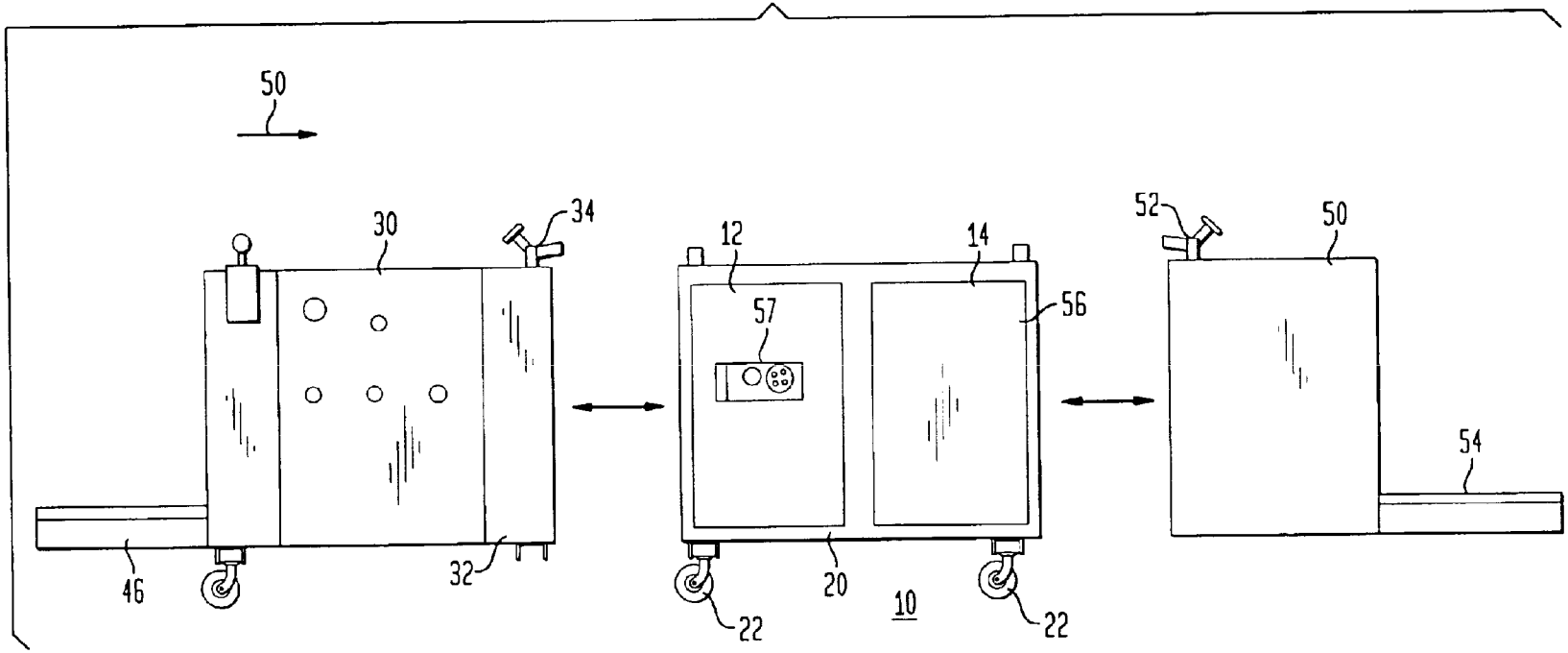
FIG. 3 is a simplified schematic plan representation of the dual compartment washer unit of FIG. 1, shown from the other side, and in combination with the grate receiving portion and a grate delivery portion.

FIG. 3 is a simplified schematic plan representation of dual compartment washer unit 10 of FIG. 1, shown from the other side, and in separated combination with grate receiving portion 30 and a grate delivery portion 50. As shown in this figure, grate delivery portion 50 can be coupled to dual compartment washer unit 10 by a further latch 52. When attached, grate receiving portion 30, dual compartment washer unit 10, and a grate delivery portion 50 form an integrated arrangement for cleaning grates. Grate delivery portion 50 is arranged to receive first grate 38 (not shown in this figure) after it has been washed on both sides thereof in first and second washer compartments 12 and 14, respectively, of dual compartment washer unit 10. The cleaned grate is ultimately urged onto a delivery dock 54, from which, in this specific illustrative embodiment of the invention, it is removed by the human operator.

As shown in FIG. 3 with respect to second washer compartment 14, the opposite side of the compartment, distal from the second multi-nozzle pressurized fluid dispenser (not shown), there is provided a compartment cover 56 that seals the washer compartment. A similar cover (not shown) is provided on the other side of first washer compartment 12. In addition to the foregoing, first washer compartment 12 is shown to have a pressurized fluid dispenser drive arrangement 57 that serves to cause rotation of rotary pressurized fluid dispensing arrangement 16, shown in FIGS. 1 and 2.

Figure 4:
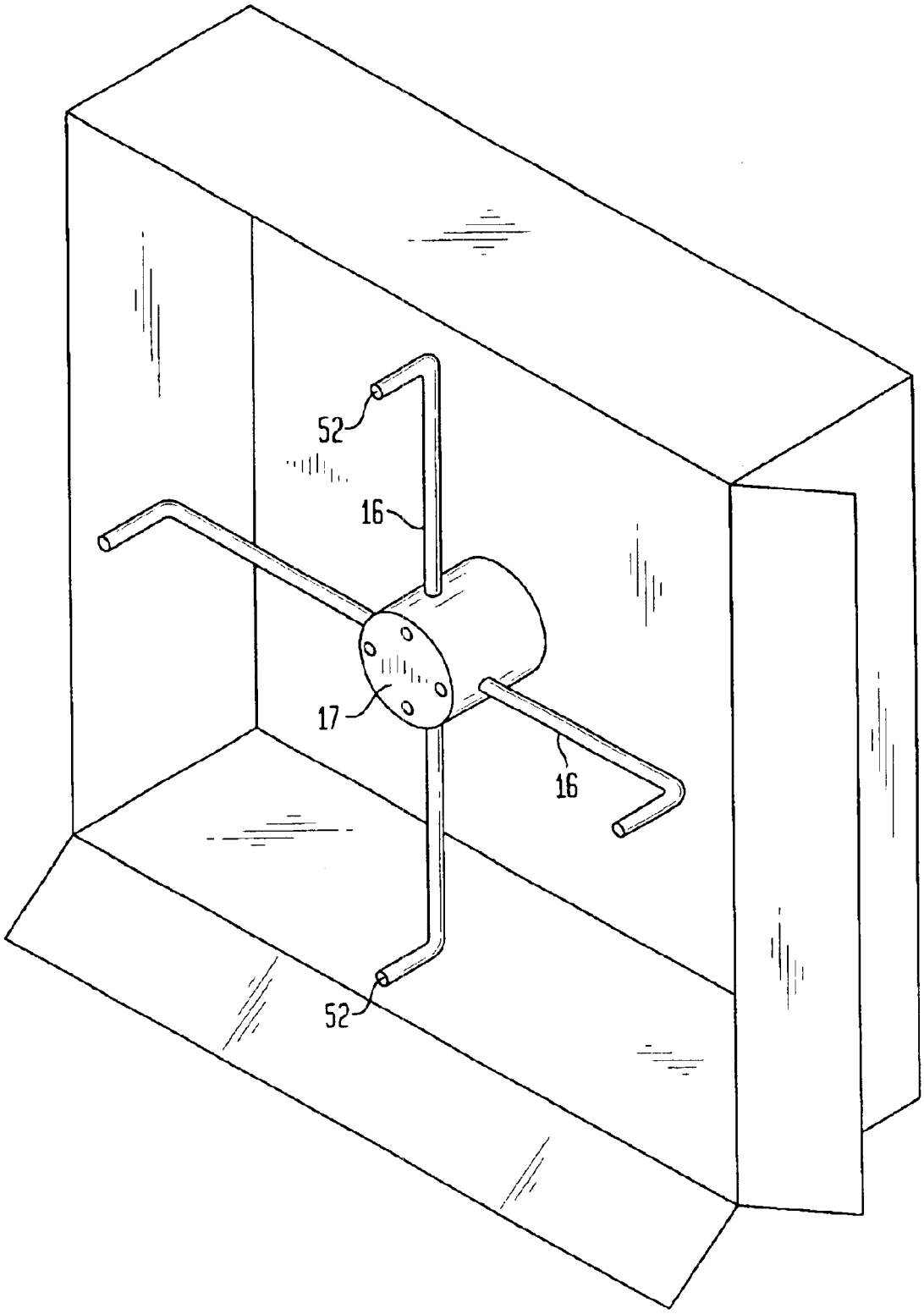
FIG. 4 is a simplified schematic isometric representation of a rotary pressurized fluid dispensing arrangement for use in the compartments of the washer unit of FIG. 1.

FIG. 4 is a simplified schematic isometric representation that shows in greater detail the elements of structure of rotary pressurized fluid dispensing arrangement 16 that is used in first washer compartment 12 of dual compartment washer unit 10 of FIG. 1. Elements of structure that previously have been discussed are similarly designated. In this specific illustrative embodiment of the invention, a further rotary pressurized fluid dispensing arrangement (not shown), which is identical to that shown in this figure, is employed in second washer compartment 14.

As previously noted, is arranged to be rotatable about its center 17. Pressurized fluid, which may be water, is issued, in this embodiment, from four nozzles 52, which are rotated about center 17. The rotation is effected by pressurized fluid dispenser drive arrangement 57, as previously noted.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A system for cleaning a plurality of grates, each grate being of the type having a corresponding predetermined length characteristic, the system comprising:

a first power wash portion for applying a pressurized wash fluid to a first side of each of first and second grates, the first and second grates being of the type that have waste paint dried on the respective first sides thereof, the pressurized fluid from said first pressure wash portion being applied at a pressure sufficient to blast the waste paint off of the first side of each of the first and second grates;

a second power wash portion for applying a further pressurized wash fluid to a second side of each of the first and second grates, the first and second grates being of the type that have waste paint dried on the respective second sides thereof the pressurized fluid from said second power wash portion being applied at a pressure sufficient to blast the waste paint off of the second side of each of the first and second grates; and a transport arrangement for defining a grate path through the first and second power wash portions, said transport arrangement further having a grate drive arrangement for engaging the first grate and urging the first grate while the first grate is in a vertical orientation along an initial portion of the grate path for a distance corresponding to the length characteristic of the first grate, and subsequently urging the second grate while the second grate is in a vertical orientation along the initial portion of the grate path for a distance corresponding to the length characteristic of the second grate, whereby the urging of the second grate along the first portion of the grate path applies a linear force to the first grate that urges the first grate along the remainder of the grate path.

2. The system of claim 1, wherein the pressurized wash fluid and the further pressurized wash fluid are obtained from a common source.

3. The system of claim 2, wherein the pressurized wash fluid and the further pressurized wash fluid are both pressurized wash water.

4. The system of claim 1, wherein there is further provided a grate delivery portion for receiving the first grate after being transported along the grate path through said second power wash portion.

5. The system of claim 4, wherein said grate delivery portion is arranged to be detachable from said second power wash portion.

6. The system of claim 1, wherein said transport arrangement comprises a receiving portion for receiving the first grate, wherein the grate drive arrangement engages with the first grate and urges same along the initial portion of the grate path from a receiving area of said receiving portion to said first power wash portion.

7. The system of claim 6, wherein said receiving portion of said transport arrangement is arranged to be detachable from said first power wash portion.

8. The system of claim 6, wherein said drive arrangement comprises:

a rotatory driver element for producing a rotatory displacement; and a flexible driven element coupled to said rotatory driver and adapted to engage with the first grate whereby the first grate is urged along the grate path from said receiving area to said first power wash portion in response to the rotatory displacement of said rotatory driver element.

9. The system of claim 8, wherein a second grate is received at the receiving area sequentially behind the first grate, whereby the second grate is urged along the grate path from the receiving area to said first power wash portion in response to the rotatory displacement of said rotatory driver element, the second grate urging the first grate along the remaining portion of the grate path from said first wash portion to said second wash portion.

10. The system of claim 1, wherein said first power wash portion comprises:

a first pressurized fluid source for delivering a stream of pressurized fluid to the first side of the first grate; and a first cover detachably arranged on the other side of the grate path from said first displaceable pressurized fluid source for forming a power wash chamber in said first power wash portion.

11. The system of claim 10, wherein said second power wash portion comprises:

a second pressurized fluid source for delivering a stream of pressurized fluid to the second side of the first grate; and a second cover detachably arranged on the other side of the grate path from said second displaceable pressurized fluid source for forming a power wash chamber in said second power wash portion, the second power wash chamber being arranged sequential to the first power wash chamber along the grate path.

12. The system of claim 10, wherein said first pressurized fluid source comprises a first displaceable nozzle for providing the stream of pressurized fluid directed toward the first side of the first grate, the stream of pressurized fluid being displaceable with respect to the first grate.

13. The system of claim 12, wherein said first displaceable nozzle is rotationally displaceable.

14. The system of claim 13, wherein there is further provided a first nozzle drive arrangement for driving said first displaceable nozzle and the stream of pressurized fluid along a predetermined path with respect to the first side of the first grate.

15. The system of claim 14, wherein the first nozzle drive arrangement drives said first displaceable nozzle along a substantially arcuate path that is substantially parallel to the first side of the first grate.

16. A system for washing grates of the type used in the ventilation of painting booths, the system comprising:

a first power wash portion for applying a moving stream of pressurized wash water to a first side of each grate;

a first power wash drive arrangement for urging the stream of pressurized wash water along a first predetermined stream path;

a second power wash portion for applying a further moving stream of pressurized wash water to a second side of each grate;

a second power wash drive arrangement for urging the further stream of pressurized wash water along a second predetermined stream path; and a grate transport arrangement for urging the grates in sequence along a grate path through the first and second power wash portions, each of the grates being urged along a portion of the grate path directly by said grate transport arrangement, and along a remaining portion of the grate path in response to urging by a subsequent one of the grates.

17. The system of claim 16, wherein said grate transport arrangement comprises:

a grate receiving portion for receiving each grate and defining a first portion of the grate path;

a cleaning portion of the grate path for conducting each grate through the first and second power wash portions; and a grate delivery portion for depositing each grate after it has been cleaned.

18. The system of claim 17, wherein said grate transport arrangement is arranged to transport the grates in a vertical orientation along the grate path, and there is further provided a guide arrangement for maintaining the vertical orientation throughout the grate path.

19. The system of claim 17, wherein said grate receiving portion is detachable from said cleaning portion of the grate path.

20. The system of claim 17, wherein said grate delivery portion is detachable from said cleaning portion of the grate path.

21. The system of claim 16, wherein said grate transport arrangement comprises a grate drive arrangement for imparting a translation force to each grate in the direction of the grate path.

22. The system of claim 16, wherein there are further provided:

a first detachable cover for forming a first power wash chamber that includes said first power wash drive arrangement; and a second detachable cover for forming a second power wash chamber that includes said second power wash drive arrangement, said first and second power wash chambers being sequentially arranged along the grate path.

23. The system of claim 22, wherein there is further provided a support wheel for supporting said first and second power wash chambers and facilitating mobility thereof.

* * * * *